US006217255B1

(12) United States Patent
Knell et al.

(10) Patent No.: US 6,217,255 B1
(45) Date of Patent: Apr. 17, 2001

(54) CLEANER MODULE FOR A COMPACTING MACHINE AND AN ASSOCIATED METHOD OF OPERATING A COMPACTING MACHINE

(75) Inventors: Harvey Knell, Yorkville, IL (US); Daryl Halvorsen, Cologne; Gary Ohlrogge, Lino Lakes, both of MN (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 09/204,849

(22) Filed: Dec. 3, 1998

(51) Int. Cl.[7] ..... E01K 19/26
(52) U.S. Cl. ..... 404/129; 404/124; 404/122
(58) Field of Search ..... 404/122, 129, 404/124; 701/50; 37/209, 231, 237

(56) References Cited

U.S. PATENT DOCUMENTS

| | | | | |
|---|---|---|---|---|
| 1,942,655 | * | 1/1934 | McCormick et al. | 404/129 |
| 2,108,291 | * | 2/1938 | McNally | 404/129 |
| 3,085,484 | * | 4/1963 | McAdams et al. | 404/129 |
| 3,633,471 | | 1/1972 | Randour | 94/50 PR |
| 3,802,339 | * | 4/1974 | Andersson et al. | 404/129 |
| 3,875,666 | * | 4/1975 | Cline | 404/129 |
| 4,040,762 | * | 8/1977 | Nilsson | 404/122 |
| 4,348,134 | * | 9/1982 | Goehler | 404/129 |
| 5,360,288 | | 11/1994 | O'Neill et al. | 404/129 |
| 5,988,940 | * | 11/1999 | Johansson | 404/129 |

* cited by examiner

*Primary Examiner*—David Bagnell
*Assistant Examiner*—Raymond W Addie
(74) *Attorney, Agent, or Firm*—Maginot, Addison & Moore; Liza J. Meyers

(57) ABSTRACT

A cleaner module adapted for use on a compacting machine having (i) a compaction wheel and (ii) a pair of compaction tips secured to a peripheral surface of the compaction wheel such that the pair of compaction tips are spaced apart from each other so as to define a wheel space interposed therebetween is disclosed. The cleaner module includes a cleaner rod having a cleaning end. The cleaner module also includes a first bearing member which supports the cleaner rod. The cleaner module further includes an actuation mechanism operatively coupled to the cleaner rod for positioning the cleaner rod between an extended position and a retracted position, wherein (i) the cleaning end of the cleaner rod is located a distance $D_1$ from the peripheral surface of the compaction wheel when the cleaner rod is located in the extended position, (ii) the cleaning end of the cleaner rod is located a distance $D_2$ from the peripheral surface of the compaction wheel when the cleaner rod is located in the retracted position, and (iii) the distance $D_2$ is greater than the distance $D_1$. An associated method of operating a compacting machine is also disclosed.

17 Claims, 3 Drawing Sheets

CLEANER MODULE FOR A COMPACTING MACHINE AND AN ASSOCIATED METHOD OF OPERATING A COMPACTING MACHINE

TECHNICAL FIELD OF THE INVENTION

The present invention relates generally to a compacting machine, and more particularly to a cleaner module for a compacting machine and an associated method of operating a compacting machine.

BACKGROUND OF THE INVENTION

Work machines, such as compacting machines, are utilized to compact material disposed in a land fill. Compacting such material decreases its volume and thus increases the amount of disposed material the land fill is capable of accepting.

Compacting machines typically include compaction wheels having a plurality of compaction tips secured to each compaction wheel. Each compaction tip is spaced apart from the adjacent compaction tip such that a space is defined therebetween. During use, the compacting machine is driven over the surface of the land fill such that the compaction tips engage and compact the material contained within the land fill.

However, a problem with the above described arrangement is that the space defined between each adjacent pair of compaction tips tends to collect material as the compacting machine is driven over the land fill. Collecting material in this space tends to decrease the compactive pressure of the compacting machine. In addition, collecting material in this space tends to cause the compaction wheels of the compacting machine to slip and loose traction.

In an attempt to address the above described problem some compacting machines are equipped with cleaner rods. The cleaner rods are attached to the compacting machine such that the cleaner rods are permanently positioned within the space defined between each adjacent pair of compaction tips. Each cleaner rod operates to dislodge material collected within the space as the compacting machine is driven over the surface of the land fill.

However, having cleaner rods permanently positioned within the space defined between each adjacent pair of compaction tips also has disadvantages. For example, when the compacting machine is driven forward, the direction of rotation of the compaction wheel relative to the cleaner rods is such that the cleaner rods effectively dislodge material from the space so that the material falls to the ground. However, when the compacting machine is driven in reverse, the direction of rotation of the compaction wheel relative to the cleaner rods is such that the material dislodged from the space accumulates on top of the cleaner rods. Having the material accumulate on top of the cleaner rods can cause maintenance problems. For instance, having the material accumulate on top of the cleaner rods increases the probability that some of the material may become wrapped around an axle of the compacting machine. Having the material wrapped around the axle inhibits the rotation of the compaction wheel. In addition, the wrapped material can eventually destroy the compaction wheel by constantly rubbing against a side structure thereof. Furthermore, having the material accumulate on top of the cleaner rods increases the probability that some of the material may bridge between the cleaner rods. Having the material bridged in the aforementioned manner causes excessive mechanical loads to be imparted to the cleaner rods as the compaction wheel rotates. These excessive mechanical loads can eventually cause the cleaner rods to fail structurally and become detached from the compacting machine.

What is needed therefore is a cleaner module for a compacting machine and an associated method of operating a compacting machine which overcomes one or more of the above-mentioned drawbacks.

DISCLOSURE OF THE INVENTION

In accordance with a first embodiment of the present invention, there is provided a cleaner module adapted for use on a compacting machine having (i) a compaction wheel and (ii) a pair of compaction tips secured to a peripheral surface of the compaction wheel such that the pair of compaction tips are spaced apart from each other so as to define a wheel space interposed therebetween. The cleaner module includes a cleaner rod having a cleaning end. The cleaner module also includes a first bearing member which supports the cleaner rod. The cleaner module further includes an actuation mechanism operatively coupled to the cleaner rod for positioning the cleaner rod between an extended position and a retracted position, wherein (i) the cleaning end of the cleaner rod is located a distance $D_1$ from the peripheral surface of the compaction wheel when the cleaner rod is located in the extended position, (ii) the cleaning end of the cleaner rod is located a distance $D_2$ from the peripheral surface of the compaction wheel when the cleaner rod is located in the retracted position, and (iii) the distance $D_2$ is greater than the distance $D_1$.

In accordance with a second embodiment of the present invention, there is provided a compacting machine. The compacting machine includes a frame and a compaction wheel rotatably secured to the frame. The compaction machine also includes a first compaction tip secured to a peripheral surface of the compaction wheel. The compacting machine further includes a second compaction tip secured to the peripheral surface of the compaction wheel such that the second compaction tip is spaced apart from the first compaction tip so as to define a wheel space interposed therebetween. The compacting machine also includes a cleaner module attached to the frame. The cleaner module includes (i) a cleaner rod having a cleaning end, (ii) a first bearing member which supports the cleaner rod, and (iii) an actuation mechanism operatively coupled to the cleaner rod for positioning the cleaner rod between an extended position and a retracted position, wherein (i) the cleaning end of the cleaner rod is located a distance $D_1$ from the peripheral surface of the compaction wheel when the cleaner rod is located in the extended position, (ii) the cleaning end of the cleaner rod is located a distance $D_2$ from the peripheral surface of the compaction wheel when the cleaner rod is located in the retracted position, and (iii) the distance $D_2$ is greater than the distance $D_1$.

In accordance with a third embodiment of the present invention there is provided a method of operating a compacting machine having (i) a compaction wheel, (ii) a first compaction tip secured to a peripheral surface of the compaction wheel, and (iii) a second compaction tip secured to the peripheral surface of the compaction wheel such that the second compaction tip is spaced apart from the first compaction tip so as to define a wheel space interposed therebetween. The method includes the step of providing a cleaner module attached to the compacting machine. The cleaner module having (i) a cleaner rod having a cleaning end, (ii) a first bearing member which supports the cleaner rod, and (iii) an actuation mechanism operatively coupled to the cleaner rod for positioning the cleaner rod between an extended position and a retracted position, wherein (i) the cleaning end of the cleaner rod is located a distance $D_1$ from the peripheral surface of the compaction wheel when the cleaner rod is located in the extended position, (ii) the cleaning end of the cleaner rod is located a distance $D_2$ from the peripheral surface of the compaction wheel when the cleaner rod is located in the retracted position, and (iii) the distance $D_2$ is greater than the distance $D_1$. The method also includes the step of operating the compacting machine for a first time period with the cleaner rod located in the extended position. The method further includes the step of locating the cleaner bar in the retracted position. The method also includes the step of operating the compacting machine for a second time period with the cleaner rod located in the retracted position.

BEST MODE FOR CARRYING OUT THE INVENTION

Figure 1:
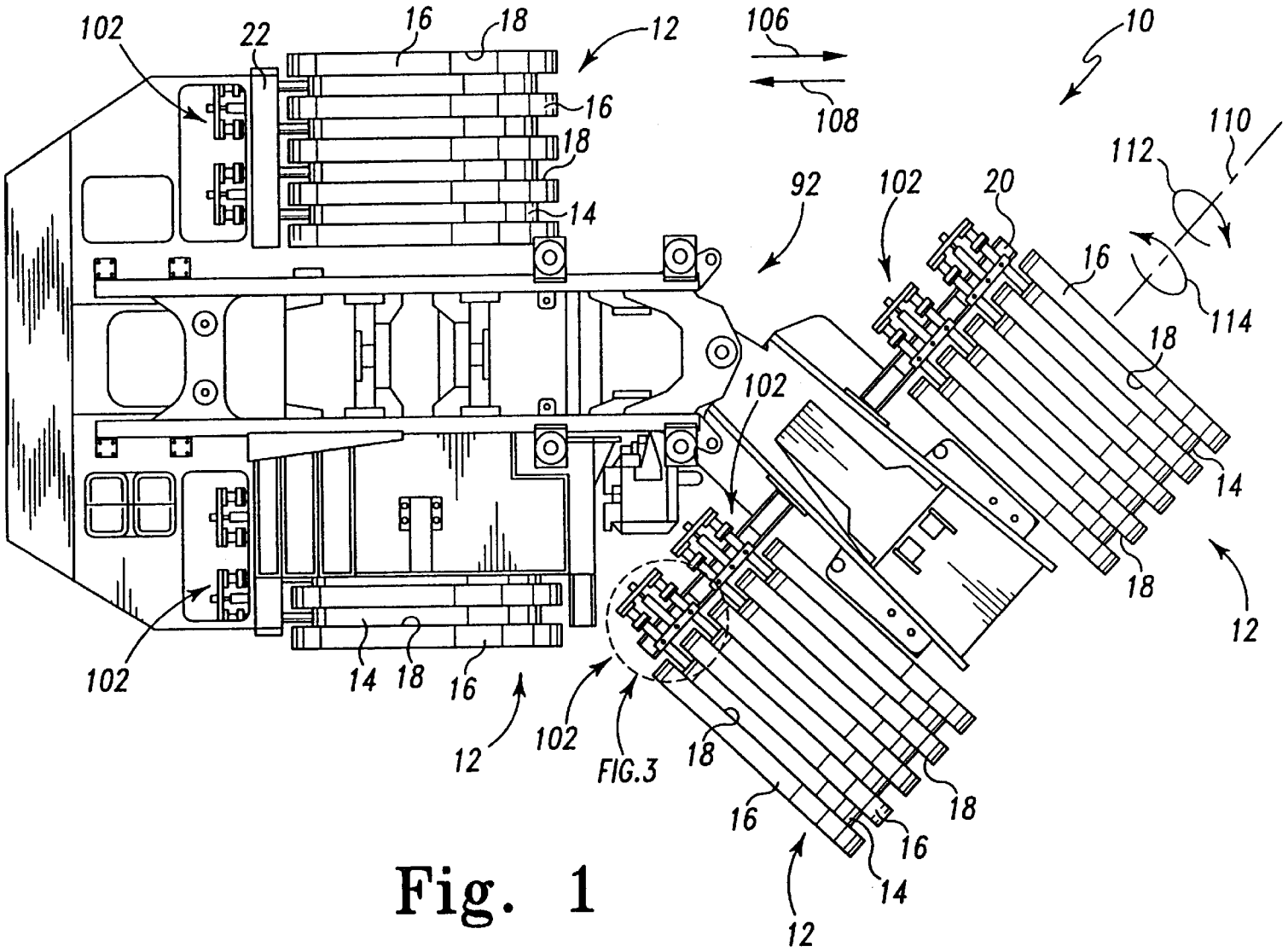
FIG. 1 is a top elevational view of a compacting machine which incorporates the features of the present invention therein.

While the invention is susceptible to various modifications and alternative forms, a specific embodiment thereof has been shown by way of example in the drawings and will herein be described in detail. It should be understood, however, that there is no intent to limit the invention to the particular form disclosed, but on the contrary, the intention is to cover all modifications, equivalents, and alternatives falling within the spirit and scope of the invention as defined by the appended claims.

Referring now to FIG. 1 there is shown a compacting machine which incorporates the features of the present invention therein. Compacting machine 10 includes a frame 92 having a striker bar 20 and a striker bar 22. Compacting machine 10 also includes a number of cleaner modules 44 (see FIG. 2) secured to either striker bar 20 or striker bar 22. Compacting machine 10 further includes a number of compaction wheels 12 rotatably secured to frame 92 such that each compaction wheel 12 is adjacent to either striker bar 20 or striker bar 22. Compacting machine 10 also includes an engine (not shown) operatively coupled to each compaction wheel 12 such that compacting machine 10 can be driven in a forward direction as indicated by arrow 106 or in a reverse direction as indicated by arrow 108.

Each compaction wheel 12 has a peripheral surface 14 with a number of compaction tips 16 secured thereto. Each compaction tip 16 is spaced apart from the adjacent compaction tip 16 so as to define a wheel space 18 interposed therebetween.

Figure 2:
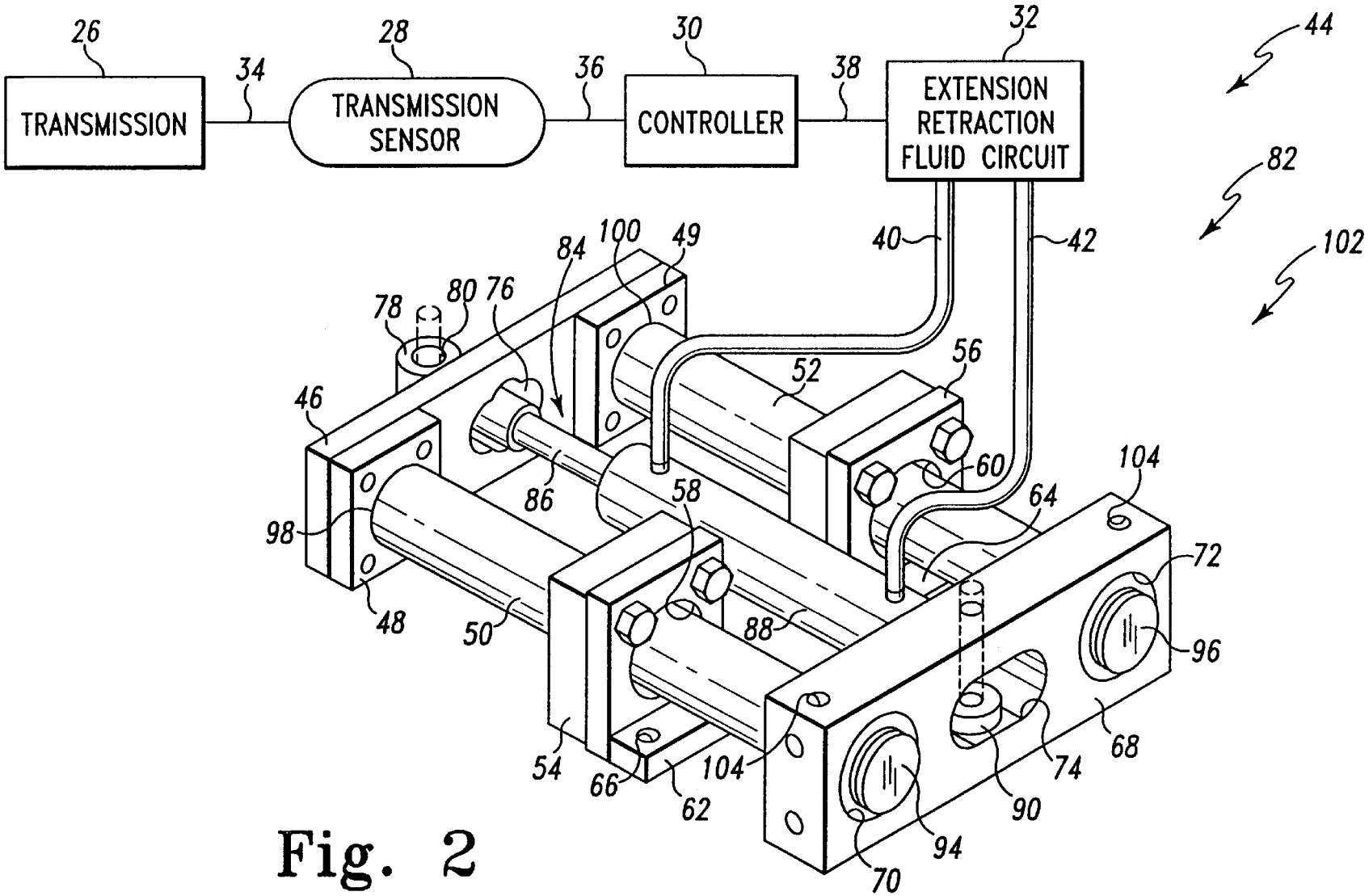
FIG. 2 is a partial perspective, partial schematic view of a cleaner module of the compacting machine of FIG. 1.

Referring now to FIG. 2, each cleaner module 44 includes a cleaner rod assembly 102 (also see FIG. 1), an actuation mechanism 82, a controller 30, a transmission sensor 28, and a transmission 26 which is selectively operable between a forward mode and a reverse mode. It should be appreciated that transmission 26 is operatively coupled to (i) the engine (not shown) of compacting machine 10 and (ii) each compaction wheel 12 such that when transmission 26 is in the forward mode compacting machine 10 is driven forward by the engine (i.e. in the direction indicated by arrow 106 of FIG. 1). Alternatively, when transmission 26 is in the reverse mode, compacting machine 10 is driven in the reverse direction by the engine (i.e. in the direction indicated by arrow 108 of FIG. 1).

Each cleaner rod assembly 102 includes a bearing member 68 having a pair of apertures 70 and 72 defined therein, a bearing member 54 having an aperture 58 defined therein, a bearing member 56 having an aperture 60 defined therein, and a support plate 46 having an adapter 78 extending therefrom. Each cleaner rod assembly 102 also a pair of cleaner rods 50 and 52.

An end 98 of cleaner rod 50 is secured to support plate 46 with a mounting plate 48. Bearing member 54 is positioned relative to cleaner rod 50 such that cleaner rod 50 extends through aperture 58. Bearing member 68 is positioned relative to cleaner rod 50 such that a cleaning end 94 thereof extends through aperture 70. Positioning cleaner rod 50, bearing member 54, and bearing member 68 in the above described manner results in (i) bearing members 54 and 68 supporting cleaner rod 50 and (ii) bearing member 54 being interposed between support plate 46 and bearing member 68.

In a similar manner, an end 100 of cleaner rod 52 is secured to support plate 46 with a mounting plate 49. Bearing member 56 is positioned relative to cleaner rod 52 such that cleaner rod 52 extends through aperture 60. Bearing member 68 is positioned relative to cleaner rod 52 such that a cleaning end 96 thereof extends through aperture 72. Positioning cleaner rod 52, bearing member 56, and bearing member 68 in the above described manner results in (i) bearing members 56 and 68 supporting cleaner rod 52 and (ii) bearing member 56 being interposed between support plate 46 and bearing member 68.

Each cleaner rod assembly 102 is secured to either striker bar 20 or striker bar 22 adjacent to a compaction wheel 12, as shown in FIG. 1. In addition, each cleaner rod assembly 102 is secured to either striker bar 20 or striker bar 22 such that (i) cleaning end 94 of cleaner rod 50 is aligned with a wheel space 18 and (ii) cleaning end 96 of cleaner rod 52 is aligned with a wheel space 18. For example, as shown more clearly in FIGS. 3 and 4, a cleaner rod assembly 102 is positioned relative to striker bar 20 so that a support bracket 62 (see FIG. 2) extending from bearing member 54 contacts striker bar 20. Cleaner rod assembly 102 is also positioned relative to striker bar 20 so that a support bracket 64 (see FIG. 2) extending from bearing member 56 contacts striker bar 20. Cleaner rod assembly 102 is further positioned relative to striker bar 20 such that bearing member 68 contacts striker bar 20. Cleaner rod assembly 102 is then secured to striker bar 20 with a number of bolts. For example, bolts are inserted through bolt hole 66 (see FIG. 2) and bolt holes 104 (see FIG. 2) to secure cleaner rod assembly 102 to striker bar 20.

Actuation mechanism 82 includes a hydraulic cylinder 84 and an extension retraction fluid circuit 32. Hydraulic cylinder 84 includes a hydraulic cylinder rod 86 and a hydraulic cylinder housing 88. Hydraulic cylinder 84 is positioned relative to cleaner rod assembly 102 such that hydraulic cylinder rod 86 extends through a rod aperture 76 defined in support plate 46. Hydraulic cylinder 84 is further positioned relative to cleaner rod assembly 102 such that an aperture (not shown) defined in hydraulic cylinder rod 86 aligns with an aperture 80 defined in adapter 78. A pin (shown in phantom in FIG. 2) is then inserted through the aperture defined in hydraulic cylinder rod 86 and aperture 80 so as to secure hydraulic cylinder rod 86 to support plate 46. Hydraulic cylinder 84 is also positioned relative to cleaner rod assembly 102 such that a housing adapter 90 extending from hydraulic cylinder housing 88 extends into a cylinder adapter 74 defined in bearing member 68. A pin (shown in phantom in FIG. 2) is then inserted through an aperture defined in bearing member 68 and an aperture defined in adapter 90 so as to secure hydraulic cylinder housing 88 bearing member 68.

Figure 4:
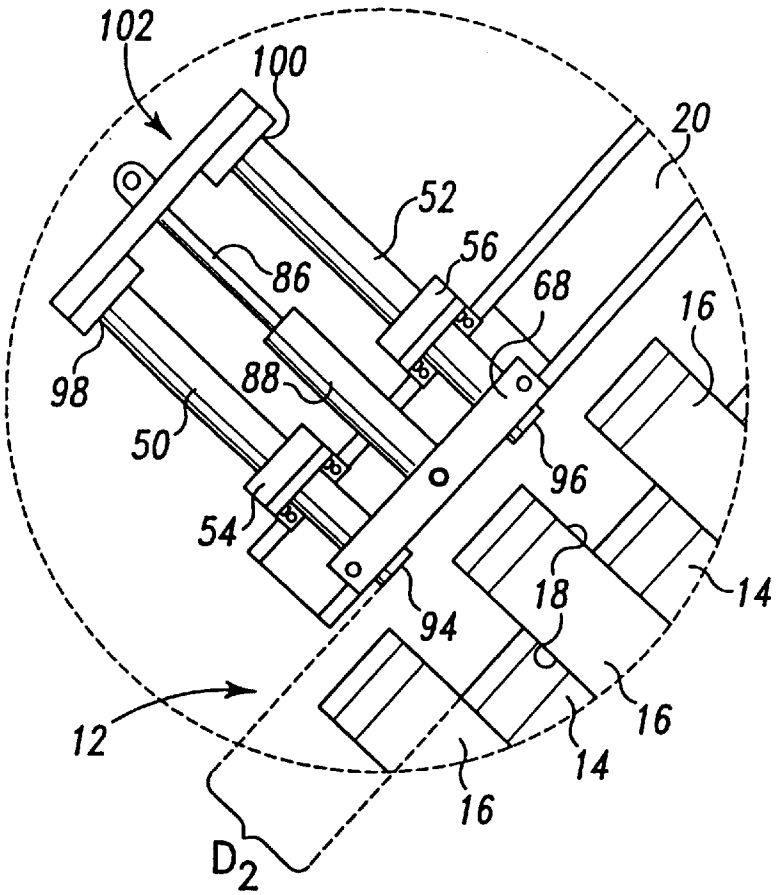
FIG. 4 is a view similar to FIG. 3, but showing the cleaner rods in the retracted position.
Figure 3:
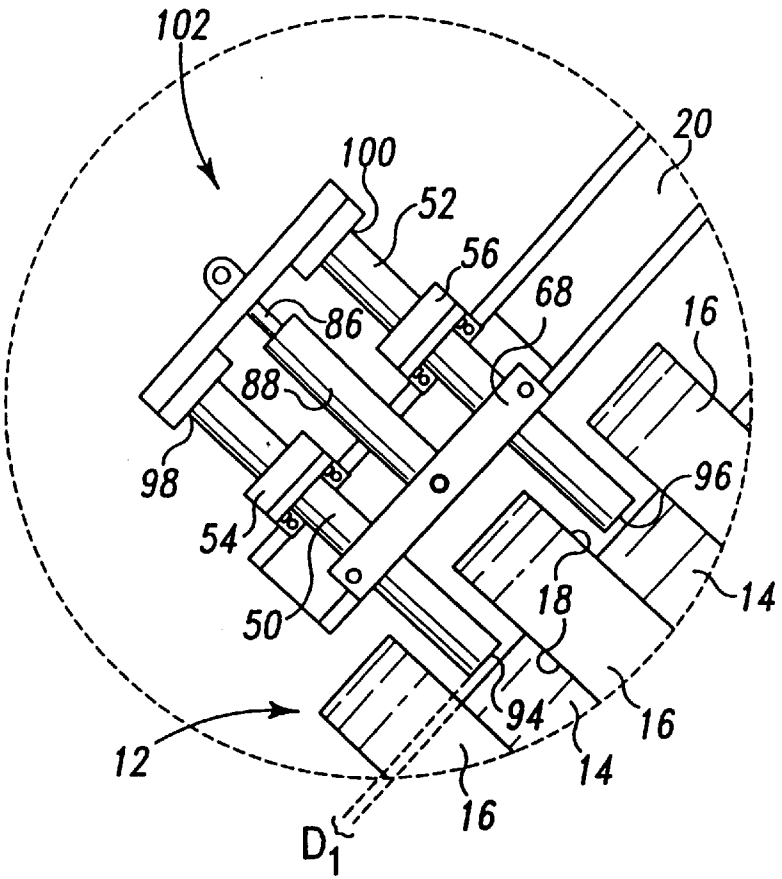
FIG. 3. is an enlarged view of a portion of FIG. 1 which is encircled and indicated as FIG. 3 showing the cleaner rods of the cleaner module located in the extended position.

It should be appreciated that hydraulic cylinder rod 86 is positionable between (i) an extended position relative to hydraulic cylinder housing 88 as shown in FIG. 4 and (ii) a retracted position relative to hydraulic cylinder housing 88 as shown in FIG. 3.

Extension retraction fluid circuit 32 is operable between an extension mode and a retraction mode. Furthermore, extension retraction circuit 32 is in fluid communication with hydraulic cylinder 84 via fluid lines 40 and 42. It should be understood that when extension retraction circuit 32 is in the extension mode, extension retraction circuit 32 causes hydraulic cylinder rod 86 to be in the extended position relative to hydraulic cylinder housing 88 as shown in FIG. 4. It should also be understood that when extension retraction circuit 32 is in the retraction mode, extension retraction circuit 32 causes hydraulic cylinder rod 86 to be in the retracted position relative to hydraulic cylinder housing 88 as shown in FIG. 3.

Having hydraulic cylinder 84 secured to cleaner rod assembly 102 in the above described manner causes cleaner rod 50 and cleaner rod 52 to be positioned in (i) an extended position when hydraulic cylinder rod 86 is positioned in the retracted position as shown in FIG. 3 and (ii) a retracted position when hydraulic cylinder rod 86 is positioned in the extended position as shown in FIG. 4. Moreover, positioning each cleaner rod assembly 102 relative to a compaction wheel 12 such that cleaning end 94 of cleaner rod 50 is aligned with a wheel space 18 results in (i) cleaning end 94 of cleaner rod 50 being located a distance $D_1$ from peripheral surface 14 of compaction wheel 12 when cleaner rod 50 is located in the extended position (see FIG. 3) and (ii) cleaning end 94 of cleaner rod 50 being located a distance $D_2$ from peripheral surface 14 of compaction wheel 12 when cleaner rod 50 is located in the retracted position (see FIG. 4). It should be appreciated that distance $D_2$ is greater than distance $D_1$. It should also be appreciated that preferably, cleaner rod 50 is (i) located in wheel space 18 when positioned in the extended position and (ii) located outside of wheel space 18 when positioned in the retracted position.

The above described spatial relationship between cleaning end 94, peripheral surface 14, and wheel space 18 also applies to cleaning end 96, peripheral surface 14, and a wheel space 18 when cleaner rod 52 is positioned in the corresponding retracted or extended position.

Referring back to FIG. 2, transmission 26 is electrically coupled to transmission sensor 28 via line 34. Transmission sensor 28 is electrically coupled to controller 30 via line 36. Controller 30 is electrically coupled to extension retraction fluid circuit 32 via line 38. Transmission sensor 28 detects the operation mode of transmission 26 via line 34. Specifically, transmission sensor 28 detects whether transmission 26 is in the forward or reverse mode. If transmission 26 is in the forward mode, transmission sensor 28 generates a forward control signal which is received by controller 30 via line 36. Controller 30 generates an extend control signal in response to the forward control signal. The extend control signal generated by controller 30 is received by extension retraction fluid circuit 32 via line 38. As a result of receiving the extend control signal, extension retraction fluid circuit 32 causes hydraulic cylinder rod 86 of hydraulic cylinder 84 to be placed in the retracted position as shown in FIG. 3. Placing hydraulic cylinder rod 86 in the retracted position locates cleaner rods 50 and 52 in the extended position as shown in FIG. 3.

On the other hand, if transmission 26 is in the reverse mode, transmission sensor 28 generates a reverse control signal which is received by controller 30 via line 36. Controller 30 generates a retract control signal in response to the reverse control signal. The retract control signal generated by controller 30 is received by extension retraction fluid circuit 32 via line 38. As a result of receiving the retract control signal, extension retraction fluid circuit 32 causes hydraulic cylinder rod 86 of hydraulic cylinder 84 to be placed in the extended position as shown in FIG. 4. Placing hydraulic cylinder rod 86 in the extended position locates cleaner rods 50 and 52 in the retracted position as shown in FIG. 4.

INDUSTRIAL APPLICABILITY

During use of compacting machine 10, transmission 26 is placed in the forward mode for a period of time, and then placed in the reverse mode for a period of time. As shown in FIG. 1, when transmission 26 is in the forward mode, compacting machine 10 is driven in the direction indicated by arrow 106 such that each compaction wheel 12 rotates around a central axis 110 in a direction indicated by arrow 112. Alternatively, when transmission 26 is in the reverse mode, compacting machine 10 is driven in the direction indicated by arrow 108 such that each compaction wheel 12 rotates around central axis 110 in a direction indicated by arrow 114. Alternating between the forward mode and the reverse mode as described above happens throughout the performance of a work function utilizing compacting machine 10 (e.g. compacting the trash contained within a land fill).

As previously discussed, when transmission 26 is in the forward mode, and therefore compacting machine 10 is driven in the direction indicated by arrow 106, cleaner rods 50 and 52 are placed in the extended position as shown in FIG. 3. Having cleaner rods 50 and 52 in the extended position as compaction wheel 12 rotates in the direction indicated by arrow 112 results in cleaner rods 50 and 52 being able to effectively dislodge material which has collected in wheel space 18 so that the material falls to the ground. It should be appreciated that dislodging material from wheel space 18 in the above described manner maintains the compactive pressure of compaction tips 16. In addition, dislodging the material collecting in wheel space 18 maintains the traction of compaction wheels 12. Moreover, dislodging the material collecting in wheel space 18 in the above described manner decreases the probability that any of the previously discussed maintenance problems will occur.

However, when transmission 26 is in the reverse mode, and therefore compacting machine 10 is driven in the direction indicated by arrow 108, cleaner rods 50 and 52 are placed in the retracted position as shown in FIG. 4. Having cleaner rods 50 and 52 in the retracted position as compaction wheel 12 rotates in the direction indicated by arrow 114 prevents material from accumulating on top of cleaner rods 50 and 52. Preventing material from accumulating on top of cleaner rods 50 and 52 also decreases the probability that any of the previously discussed maintenance problems will occur.

The above described ability of cleaner module 44 to alternatively position cleaner rods 50 and 52 within, and outside of, wheel space 18 is in contrast to other cleaner module designs. Specifically, other cleaner module designs suffer from the drawback that the cleaner rods are permanently positioned within the wheel space defined between each adjacent pair of compaction tips. Having the cleaner rods permanently positioned within the wheel space can cause material to accumulate on top of the cleaner rods as the compacting machine is driven in reverse. Having the material accumulate on top of the cleaner rods increases the probability that some of the material may become wrapped around an axle of the compacting machine thereby resulting in compacting machine maintenance problems.

While the invention has been illustrated and described in detail in the drawings and foregoing description, such illustration and description is to be considered as exemplary and not restrictive in character, it being understood that only the preferred embodiment has been shown and described and that all changes and modifications that come within the spirit of the invention are desired to be protected.

What is claimed is:

1. A cleaner module for a compacting machine having (i) a compaction wheel and (ii) a pair of compaction tips secured to a peripheral surface of said compaction wheel such that said pair of compaction tips are spaced apart from each other so as to define a wheel space interposed therebetween, said cleaner module comprising:

a cleaner rod having a cleaning end;

an actuation mechanism operatively coupled to said cleaner rod for positioning said cleaner rod between an extended position and a retracted position, wherein (i) said cleaning end of said cleaner rod is located a distance $D_1$ from said peripheral surface of said compaction wheel when said cleaner rod is located in said extended position, (ii) said cleaning end of said cleaner rod is located a distance $D_2$ from said peripheral surface of said compaction wheel when said cleaner rod is located in said retracted position, and (iii) said distance $D_2$ is greater than said distance $D_1$; and a compacting machine transmission which is selectively operable between a forward mode and a reverse mode, wherein said actuation mechanism is operatively coupled to said compacting machine transmission such that (i) said cleaner rod is located in said extended position when said compacting machine transmission is in said forward mode and (ii) said cleaner rod is located in said retracted position when said compacting machine transmission is in said reverse mode.

2. The cleaner module of claim 1, wherein:

said cleaner rod is located in said wheel space when positioned in said extended position, and said cleaner rod is located outside of said wheel space when positioned in said retracted position.

3. The cleaner module of claim 1, further comprising:

a support plate secured to an attachment end of said cleaner rod;

a first bearing member which supports said cleaner rod; and a second bearing member supporting said cleaner rod, said second bearing member being interposed between said support plate and said first bearing member.

4. The cleaner module of claim 3, wherein:

said first and second bearing members are secured to a striker bar mounted on said compacting machine.

5. The cleaner module of claim 3, wherein:

(i) said actuation mechanism includes a hydraulic cylinder having a hydraulic rod and a hydraulic housing, (ii) said hydraulic rod is positionable between an extended position and a retracted position relative to said hydraulic housing, (iii) said hydraulic rod is secured to said support plate and said hydraulic housing is secured to said first support bearing so that when (A) said hydraulic rod is located in said extended position said cleaner rod is located in said retracted position and (B) said hydraulic rod is located in said retracted position said cleaner rod is located in said extended position.

6. The cleaner module of claim 1, wherein:

said compacting machine transmission is operatively coupled to a transmission sensor, said transmission sensor is operatively coupled to said actuation mechanism, and (i) said transmission sensor generates a forward control signal in response to said compacting machine transmission being in said forward mode such that said actuation mechanism positions said cleaner rod in said extended position and (ii) said transmission sensor generates a reverse control signal in response to said compacting machine transmission being in said reverse mode such that said actuation mechanism positions said cleaner rod in said retracted position.

7. The cleaner module of claim 6, wherein:

said transmission sensor is operatively coupled to a controller, said controller is operatively coupled to said actuation mechanism, and said controller generates an extend control signal in response to said forward control signal such that said actuation mechanism positions said cleaner rod in said extended position, and said controller generates a retract control signal in response to said reverse control signal such that said actuation mechanism positions said cleaner rod in said retracted position.

8. A compacting machine, comprising:

a frame;

a compaction wheel rotatably secured to said frame;

a first compaction tip secured to a peripheral surface of said compaction wheel;

a second compaction tip secured to said peripheral surface of said compaction wheel such that said second compaction tip is spaced apart from said first compaction tip so as to define a wheel space interposed therebetween;

a cleaner module attached to said frame, said cleaner module including (i) a cleaner rod having a cleaning end and (ii) an actuation mechanism operatively coupled to said cleaner rod for positioning said cleaner rod between an extended position and a retracted position, wherein (i) said cleaning end of said cleaner rod is located a distance $D_1$ from said peripheral surface of said compaction wheel when said cleaner rod is located in said extended position, (ii) said cleaning end of said cleaner rod is located a distance $D_2$ from said peripheral surface of said compaction wheel when said cleaner rod is located in said retracted position, and (iii) said distance $D_2$ is greater than said distance $D_1$; and a compacting machine transmission which is selectively operable between a forward mode and a reverse mode, wherein said actuation mechanism is operatively coupled to said compacting machine transmission such that (i) said cleaner rod is located in said extended position when said compacting machine transmission is in said forward mode and (ii) said cleaner rod is located in said retracted position when said compacting machine transmission is in said reverse mode.

9. The compacting machine of claim 8, wherein:

said cleaner rod is located in said wheel space when positioned in said extended position, and said cleaner rod is located outside of said wheel space when positioned in said retracted position.

10. The compacting machine of claim 8, wherein said cleaner module further includes:

a support plate secured to an end of said cleaner rod;

a first bearing member which supports said cleaner rod, and a second bearing member supporting said cleaner rod, said second bearing member being interposed between said support plate and said first bearing member.

11. The compacting machine of claim 10, wherein:

said frame includes a striker bar and said first and second bearing members are secured to said striker bar.

12. The compacting machine of claim 10, wherein:

(i) said actuation mechanism includes a hydraulic cylinder having a hydraulic rod and a hydraulic housing, (ii) said hydraulic rod is positionable between an extended position and a retracted position relative to said hydraulic housing, (iii) said hydraulic rod is secured to said support plate and said hydraulic housing is secured to said first support bearing so that when (A) said hydraulic rod is located in said extended position said cleaner rod is located in said retracted position and (B) said hydraulic rod is located in said retracted position said cleaner rod is located in said extended position.

13. The compacting machine of claim 8, wherein:

said compacting machine transmission is operatively coupled to a transmission sensor, said transmission sensor is operatively coupled to said actuation mechanism, and (i) said transmission sensor generates a forward control signal in response to said compacting machine transmission being in said forward mode such that said actuation mechanism positions said cleaner rod in said extended position and (ii) said transmission sensor generates a reverse control signal in response to said compacting machine transmission being in said reverse mode such that said actuation mechanism positions said cleaner rod in said retracted position.

14. The compacting machine of claim 13, wherein:

said transmission sensor is operatively coupled to a controller, said controller is operatively coupled to said actuation mechanism, and (i) said controller generates an extend control signal in response to said forward control signal such that said actuation mechanism positions said cleaner rod in said extended position and (ii) said controller generates a retract control signal in response to said reverse control signal such that said actuation mechanism positions said cleaner rod in said retracted position.

15. A method of operating a compacting machine including (i) a compaction wheel, (ii) a first compaction tip secured to a peripheral surface of said compaction wheel, and (iii) a second compaction tip secured to said peripheral surface of said compaction wheel such that said second compaction tip is spaced apart from said first compaction tip so as to define a wheel space interposed therebetween, comprising the steps of:

providing a cleaner module attached to said compacting machine, said cleaner module including (i) a cleaner rod having a cleaning end, and (ii) an actuation mechanism operatively coupled to said cleaner rod for positioning said cleaner rod between an extended position and a retracted position, wherein (i) said cleaning end of said cleaner rod is located a distance $D_1$ from said peripheral surface of said compaction wheel when said cleaner rod is located in said extended position, (ii) said cleaning end of said cleaner rod is located a distance $D_2$ from said peripheral surface of said compaction wheel when said cleaner rod is located in said retracted position, and (iii) said distance $D_2$ is greater than said distance $D_1$;

operating said compacting machine for a first time period with said cleaner rod located in said extended position;

locating said cleaner rod in said retracted position;

operating said compacting machine for a second time period with said cleaner rod located in said retracted position;

providing a compacting machine transmission which is operatively coupled to said actuation mechanism, said transmission being selectively operable between a forward mode and a reverse mode;

positioning said cleaner rod in said extended position when said transmission is in said forward mode; and positioning said cleaner rod in said retracted position when said transmission is in said reverse mode.

16. The method of claim 15, wherein:

said compacting machine transmission is operatively coupled to a transmission sensor, said transmission sensor is operatively coupled to said actuation mechanism, and (i) said transmission sensor generates a forward control signal in response to said compacting machine transmission being in said forward mode such that said actuation mechanism positions said cleaner rod in said extended position and (ii) said transmission sensor generates a reverse control signal in response to said compacting machine transmission being in said reverse mode such that said actuation mechanism positions said cleaner rod in said retracted position.

17. The method of claim 15, wherein:

said transmission sensor is operatively coupled to a controller, said controller is operatively coupled to said actuation mechanism, and (i) said controller generates an extend control signal in response to said forward control signal such that said actuation mechanism positions said cleaner rod in said extended position and (ii) said controller generates a retract control signal in response to said reverse control signal such that said actuation mechanism positions said cleaner rod in said retracted position.

* * * * *